US006747407B1

(12) United States Patent
Saito et al.

(10) Patent No.: US 6,747,407 B1
(45) Date of Patent: Jun. 8, 2004

(54) PLASMA DISPLAY DEVICE, AND METHOD FOR MANUFACTURING DISPLAY MODULE OF PLASMA DISPLAY DEVICE

(75) Inventors: Takashi Saito, Tokyo (JP); Katsuhiko Umeda, Tokyo (JP)

(73) Assignee: Jamco Corporation, Tokyo (JP)

( * ) Notice: Subject to any disclaimer, the term of this patent is extended or adjusted under 35 U.S.C. 154(b) by 124 days.

(21) Appl. No.: 09/671,742

(22) Filed: Sep. 29, 2000

(30) Foreign Application Priority Data

Oct. 21, 1999 (JP) ..... H11-299369

(51) Int. Cl.[7] ..... G09G 3/28
(52) U.S. Cl. ..... 313/581; 313/586; 313/114
(58) Field of Search ..... 313/581, 582, 313/586, 587, 113; 315/169.4

(56) References Cited

U.S. PATENT DOCUMENTS

| | | | | | |
|---|---|---|---|---|---|
| 4,192,060 | A | * | 3/1980 | Washizuka et al. | 29/592.1 |
| 4,569,891 | A | * | 2/1986 | Shimizu et al. | 430/57.8 |
| 5,182,489 | A | | 1/1993 | Sano | |
| 5,561,348 | A | * | 10/1996 | Schoenbach et al. | 315/169.1 |
| 5,574,327 | A | | 11/1996 | Cammack et al. | |
| 5,663,611 | A | * | 9/1997 | Seats et al. | 313/491 |
| 5,754,003 | A | * | 5/1998 | Murai et al. | 313/582 |
| 5,957,743 | A | * | 9/1999 | Konishi et al. | 313/587 |
| 6,051,928 | A | * | 4/2000 | Choi et al. | 313/485 |
| 6,091,469 | A | * | 7/2000 | Naito | 349/113 |
| 6,333,600 | B1 | * | 12/2001 | Mizobata | 313/582 |
| 6,373,191 | B1 | * | 4/2002 | Jang et al. | 313/582 |
| 6,414,435 | B1 | * | 7/2002 | Akiba | 313/584 |

FOREIGN PATENT DOCUMENTS

| | | | | |
|---|---|---|---|---|
| EP | 0 782 166 | | 7/1997 | |
| EP | 0 908 919 | | 4/1999 | |
| JP | 10293541 | * | 4/1998 | H01J/11/02 |

OTHER PUBLICATIONS

Patent Abstract of Japan, Publication No. 10293541, Publication Date: Apr. 11, 1998 (EPO).
Patent Abstract of Japan, Publication No. 06283108, Publication Date: Jul. 10, 1994. (EPO).
Patent Abstract of Japan, Publication No. 09120776, Publication Date: May 6, 1997. (EPO).

* cited by examiner

*Primary Examiner*—Nimeshkumar D. Patel
*Assistant Examiner*—Glenn Zimmerman
(74) *Attorney, Agent, or Firm*—Westerman, Hattori Daniels & Adrian, LLP

(57) ABSTRACT

A plasma display device including a back surface glass plate equipped with discharge electrodes and having electronics connected to the back surface thereof, a front surface glass plate mounted on and opposing to the back surface glass plate via separation walls and having discharge electrodes, and luminescent pixels defined by the back surface glass plate the separation wall and the front surface glass plate. The back surface glass plate of the luminescent pixel opposite the display surface is formed as a reflection surface, and a fluorescent layer is formed on said reflection surface.

1 Claim, 4 Drawing Sheets

PLASMA DISPLAY DEVICE, AND METHOD FOR MANUFACTURING DISPLAY MODULE OF PLASMA DISPLAY DEVICE

BACKGROUND OF THE INVENTION

1. Field of the Invention

The present invention relates to a plasma display device.

2. Description of the Related Art

A plasma display device is a flat panel display capable of displaying color images by generating ultraviolet light through high-voltage gas discharge, and lighting fluorescent agents of various colors painted to each pixel within the panel.

The technology related to plasma display devices has advanced remarkably during the recent years, and the plasma display devices have now reached amass production state. There exists a competition in developing a large-size plasma display device that is bright, has a wide viewing angle, has an even luminance throughout the whole screen, and that is free from distortion, effusion or mismatch of colors.

However, according to the conventional plasma display devices, a beautiful image is provided only when viewed in a dark room. The image provided by the plasma display is not bright enough to be viewed at a bright place, for example, outdoors.

The structure of a plasma display device according to the prior art is explained with reference to FIG. 5.

Electronics 3 are connected to a display module 10 through a flex lead 5. Tempered glass 9 is mounted on the display surface of the display module 10 via space 7.

The display module 10 defines discharge spaces 20 by a back surface glass 11 placed to the side of the electronics 3, separation walls 15, and a front glass 13 placed to the side of the tempered glass 9 and superposed to the back surface glass 11 through the separation walls. Data electrodes 12 are mounted on the back surface glass 11, and scan electrodes 14 are mounted on the front surface glass 13, which are covered with dielectric layers 18 and 19. Fluorescent 17 of three colors (17R, 17G, 17B) are applied on each discharge space corresponding to each pixel.

High voltage is impressed to electrodes 12 and 14 of the plasma display device formed as explained above, and gas discharge is performed within the discharge space 20 filled with neon gas including argon. Ultraviolet light is generated in each discharge space 20, and causes the fluorescent 17 of the corresponding pixel to glow.

One cause of insufficient brightness of the plasma display device is that not all of the visible radiation from the fluorescent caused by the ultraviolet light generated by the gas discharge is radiated toward the display surface or front glass 12. Visible radiation is also radiated toward the back surface glass 11 and the side surfaces (separation walls 15), and perpendicular members (such as glass) absorb the visible radiation.

In order to improve the radiation efficiency toward the display surface, there are attempts to color the dielectric layer 18 mounted to the back surface glass 11 white, so that it may reflect the visible radiation. However, the effect is not satisfying.

Moreover, many electronics 3 are mounted to the back surface of the display module 10. The heat generated form the display module 10 heats the electronics 3, causing problems.

This is because the gas discharge and the fluorescent of the display module 10 generates electromagnetic wave energy having various wavelengths, such as ultraviolet, visible radiation, heat wavelength energy and radio wavelength energy. The white-colored dielectric layer 118 mounted to the back surface of the module improves the luminance of the display by reflecting the visible radiation (electromagnetic wave having a wavelength of 0.38–0.78 micron) generated from the fluorescent. However, the white dielectric layer does not reflect electromagnetic wave energy having a long wavelength (0.78–100 micron) classified as heat wave energy, or radio wave energy (electromagnetic wave energy having a wavelength of 100 micron or greater).

Even further, the electromagnetic wave energy that has not been reflected by the dielectric layer is absorbed by the fluorescent, the white-colored dielectric layer 18 formed on the back surface, and the back surface glass plate 11 of the display module 10, and there, the electromagnetic wave energy is converted into heat energy. The heat energy causes the temperature of the back surface portion of the display module 10 to increase.

From the above reasons, there is a need to forcedly diffuse the heat of the display module, not only to protect the module but also to protect the electronics connected to the module.

SUMMARY OF THE INVENTION

The present invention provides a plasma display device having improved luminosity and bright image quality with low power consumption, and with reduced electromagnetic wave energy radiated toward the back surface of the display module equipped with electronics converting into heat energy.

The plasma display device according to the present invention comprises a display module equipped with an array of luminescent pixels, and electronics connected to the back surface of the display module wherein the front surface of the display module is a display surface, and the surface of the luminescent pixels opposite said display surface is a reflection surface.

The display module of the plasma display device according to the present invention comprises a back surface glass plate having discharge electrodes and to which are connected electronics; a front surface glass plate mounted on and opposing to the back surface glass plate via separation walls and having discharge electrodes; and luminescent pixels defined by the back surface glass plate, the separation walls and the front surface glass plate; wherein the luminescent pixels are formed so that at least the surface of the back surface glass plate opposite the display surface is a reflection surface. In another example, the luminescent pixels of the display module are formed so that all surfaces other than the surface of the front surface glass plate are reflection surfaces.

According to another aspect of the invention, the reflection surface is formed by metal plating, or by adhering metal leafs. In another example, the reflection surface opposing the display surface has a concave surface, and the light reflected from the reflection surface is condensed at the display surface.

A method for manufacturing a display module of a plasma display device according to the present invention comprises mounting electrodes covered with dielectric on a back surface glass plate and on a front surface glass plate; mounting separation walls on the back surface glass plate, thereby forming discharge space; forming a reflection surface on walls of each discharge space; and superposing the front surface glass plate functioning as a display surface on the separation walls opposite the back surface glass plate, thereby forming luminescent pixels.

According to the present invention, the shape of the discharge spaces (luminescent pixels) are changed, and reflection surfaces formed by metal plating and the like are provided to the areas that are expected to reflect the electromagnetic wave. Thereby, any electromagnetic wave energy regardless of its wavelength can be reflected toward the front direction of the pixel to improve the brightness of the display, and to minimize the radiation of energy toward the back surface of the, module.

DETAILED DESCRIPTION OF PREFERRED EMBODIMENTS

The preferred embodiments of the present invention will now be explained with reference to the drawings.

Embodiment 1

Figure 1:
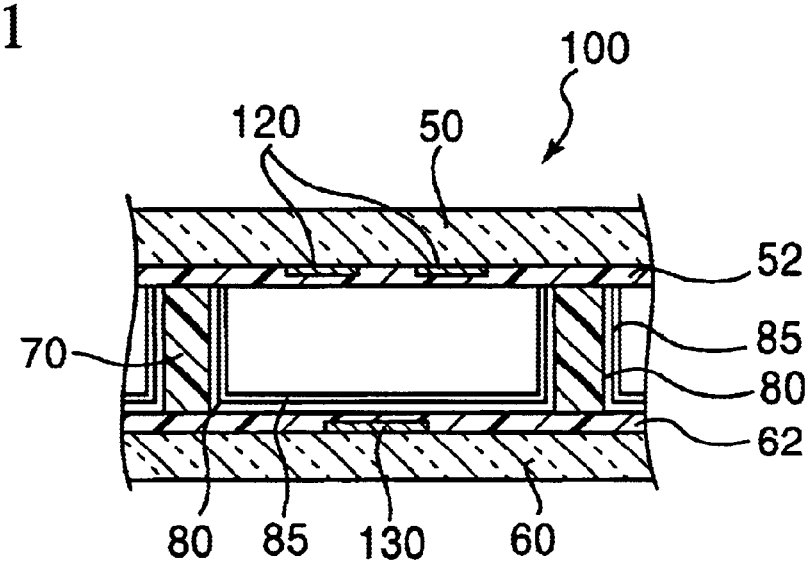
FIG. 1 is an explanatory cross-sectional view showing the structure of a display module of the plasma display device according to the present invention.
Figure 2:
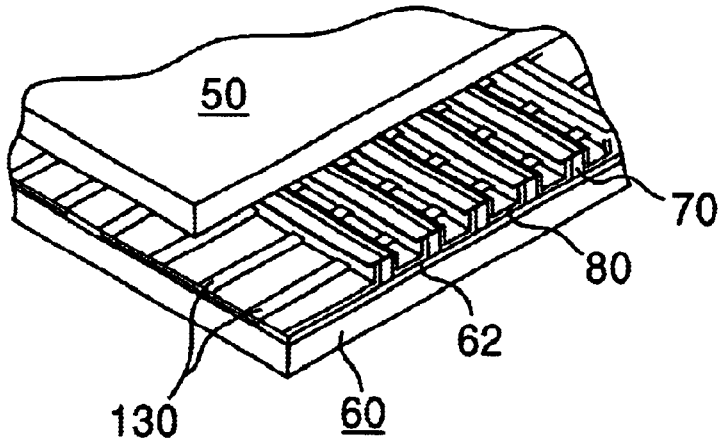
FIG. 2 is a perspective view of a display module of the plasma display device according to the present invention.

FIG. 1 is an explanatory cross-sectional view of one pixel of the display module according to the present invention. FIG. 2 is an explanatory view showing the structure of the display module.

The display module 100 comprises discharges paces 110, each defined by a front glass plate 50, a back,glass plate 60, and separation walls 70.

Electrodes 120 are mounted on the front glass plate 50, which are covered with a dielectric layer 52.

Electrodes 130 are mounted on the back glass plate 60, which are covered with a dielectric layer 62.

Metal plating treatment is provided to the surface of the dielectric layer 62 covering the back glass plate 60 and the surface of the separation wall 70, thereby forming a reflection surface 80. Further, a fluorescent agent is applied to the reflection surface 80 to form a fluorescent layer 85. In other words, the reflection surface 80 and the fluorescent layer 85 are provided to all inner surfaces of each discharge space 10 except for the display surface near the front glass plate 50.

According to the display module 100 formed as explained above, high voltage impressed to the electrodes 120 and electrodes 130 causes discharge to occur within each discharge space 110, and generates ultraviolet light. Ultraviolet light impinges upon the fluorescent surface 85. The ultraviolet light is reflected by the reflection surface 80, and the reflected ultraviolet light is radiated toward the front glass plate 50 having no reflection surface (in the direction of the display surface).

Next, the method for manufacturing the display module 10 equipped with a reflecting surface is explained.

First, electrodes 130 and 120 covered with dielectric 62 and 52 are formed on the back surface glass plate 60 and on the front surface glass plate 50. Thereafter, separation walls 70 are mounted on the back surface glass plate 60, thereby defining the ditch for forming the discharge space 110.

Next, a metal plating treatment and the like is applied to each of the inner wall surfaces of the discharge space 110, that is, on the surface of the dielectric 62 placed on the back surface glass plate 60 and on the wall surfaces of the separation wall 70, in order to form the reflection surface 80. Thereafter, a fluorescent layer 85 is formed on the reflection surface 80 by applying fluorescent paint thereto.

Further, the front surface glass plate 50 is superposed on the upper area of the separation walls 70. The back surface glass plate 60, the separation wall 70 and the front surface glass plate 50 define a closed discharge space 110.

Discharge is performed within each of the discharge spaces (pixels) 110 of the display module 100 formed as above. Each luminescent pixel is lighted by the ultraviolet generated by the discharge performed within each pixel, and generates light according to the fluorescent paint. All of the generated light is reflected by the reflection surface 86 toward the front surface glass, plate 50, without being absorbed by the separation walls 70 or the back surface glass plate 60. The surface luminance of the display module 100 utilizing the front surface glass plate 50 as the display surface is improved by the reflected light, and the surface becomes brighter.

Moreover, the metal-plated reflection surface 80 not only reflects visible light and ultraviolet, but also reflects all electromagnetic wave energy regardless of its wavelength. Visible light energy, electromagnetic wave energy with a long wavelength, and radio wave energy are all reflected by the reflection surface 80, and will not be absorbed by the back surface glass plate 60. As a result, no energy causing a temperature rise will reach the electronics equipped to the back surface of the module.

Embodiment 2

Figure 3:
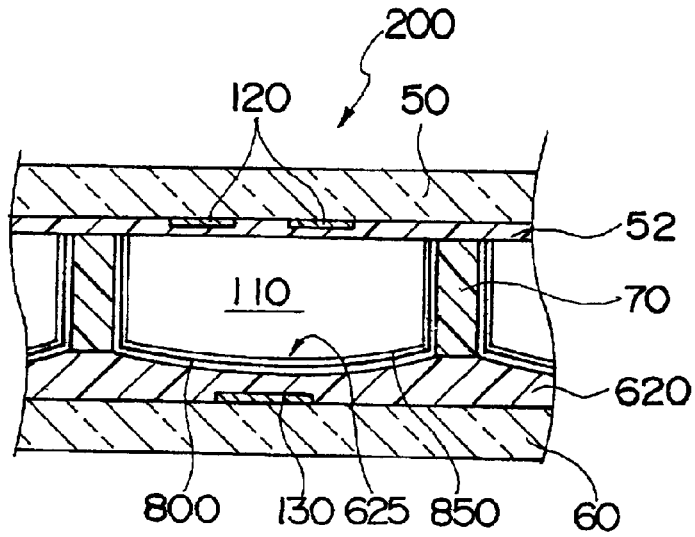
FIG. 3 is an explanatory cross-sectional view showing another embodiment of the display module.

Another embodiment for improving the luminance of the display surface of the module is explained with reference to FIG. 3.

The display module 200 defines the discharge space 110 by the front surface glass plate 50, the back surface glass plate 60 and the separation wall 70. Electrodes 120 are mounted to the front surface glass plate 50 and electrodes 130 are mounted on the back surface glass plate 60, which are covered with dielectric layers. Such structure is similar to the display module 100 of embodiment 1.

In the present embodiment, the dielectric layer 620 covering the back surface glass plate 60 comprises a concave surface 625 positioned at the center of each discharge space. Sandblasting is applied to the concave surface 625 to form a concave mirror-like surface. Thereafter, metal plating is applied to the concave surface 625 to form a reflection surface 800. Then, a fluorescent agent is applied on the surface of the metal-plated reflection surface 800, forming the fluorescent layer 850.

The display module 200 according to the present embodiment is characterize in that the visible light generated by the fluorescent layer 850 is all reflected by the reflection surface 800 having a concave surface, and the light is collected toward the front surface glass plate 50 functioning as the display surface. Therefore, the surface luminance of the display module 200 is improved greatly. Moreover, because the reflection surface 800 having a concave surface reflects all electromagnetic wave energy regardless of its wavelength, so the back surface glass plate 60 will absorb no electromagnetic wave. As a result, the electromagnetic wave energy will not heat the electronics mounted to the back surface glass plate 60.

Embodiment 3

Figure 4:
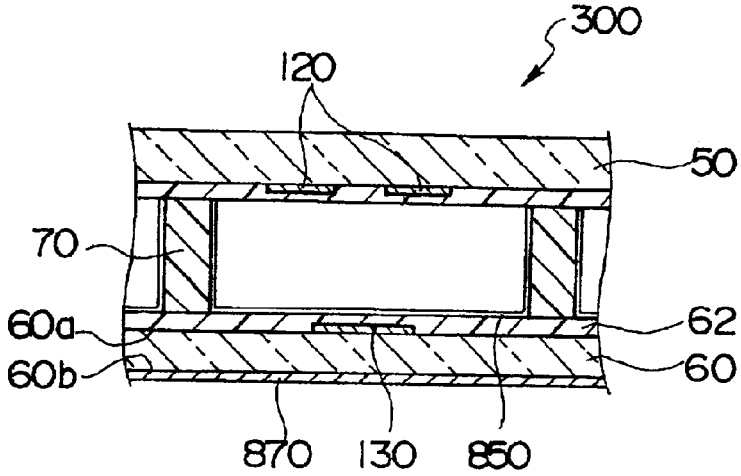
FIG. 4 is an explanatory cross-sectional view showing another embodiment of the display module.
Figure 5:
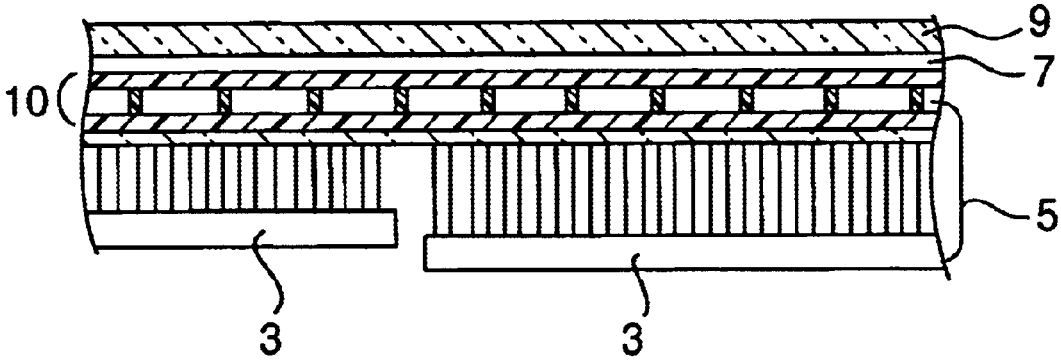
Fig. 5 Prior Art
FIG. 5 is an explanatory view of the structure of a plasma display device of the prior art.
Figure 6:
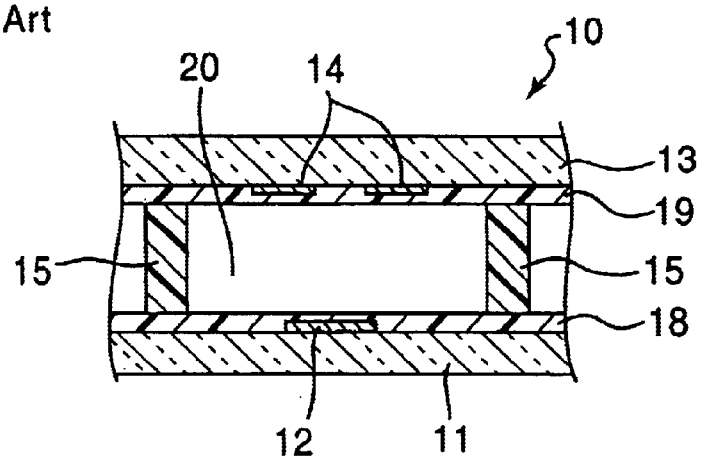
Fig. 6 Prior Art
FIG. 6 is an explanatory view of the structure of a display module according to the prior art.
Figure 7:
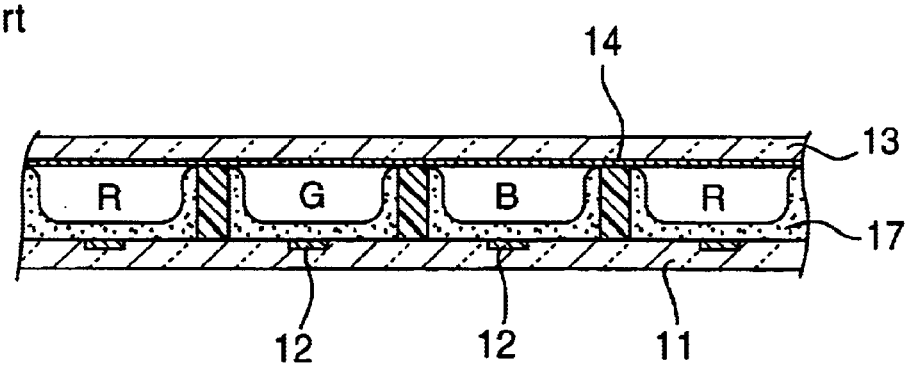
Fig. 7 Prior Art
FIG. 7 is an explanatory view of luminescent pixels.

Another embodiment of the present invention is explained with reference to FIG. 4.

The present display module is similar to the display module 100 of embodiment 1 in that discharge spaces 110 are defined by the separation walls 70, the front surface glass plate 50, and the back surface glass plate 60, and that electrodes 120 are mounted on the front surface glass plate 50 and electrodes 130 are mounted on the back surface glass plate 60, which are covered by dielectric layers 52 and 62. The display module 300 is further equipped with a reflection surface 870 formed on a back surface 60*b* of the back surface glass plate 60.

The reflection surface 870 is either formed by metal plating, or by metal leafs adhered on the back surface 60*b*.

The display module 300 reflects light by a front surface 60*a* of the back surface glass plate 60. The light transmitted through the back surface glass plate 60 is reflected by the reflection surface 870 toward the display surface or front surface glass plate 50. A portion of the electromagnetic wave energy absorbed by the back surface glass plate 60 may turn into energy and cause the temperature of the back surface 60*b* of the back surface glass plate 60 to rise. However, since most of the electromagnetic wave energy absorbed is reflected by the reflection surface 870, the temperature rise is limited to a low level. Even further, the module of the present embodiment has a simple structure, and has high reflection efficiency.

As explained, the display module according to the present embodiment reflects all of the visible light generated by the fluorescent body by the reflection mirror toward the display surface, and improves the luminance of the display surface greatly. Even further, because the reflection surface of the module reflects all electromagnetic wave energy regardless of its wavelength, the temperature of the electronics mounted to the back surface of the module is prevented from rising.

The present invention provides a display module of a plasma display device that solves the problem of heat diffusion of electronics mounted to the back surface of the module, with improved surface luminance, and with a display surface that is bright and provides good image quality, without increasing consumption power.

We claim:

1. A plasma display device comprising a display module, said display module having electronics mounted to the back surface thereof and utilizing the front surface thereof as a display surface, said display module further comprising:

a back surface glass plate having discharge electrodes;

a front surface glass plate that is mounted on and opposing to said back surface glass plate via separation walls and having discharge electrodes; and luminescent pixels defined by said back surface glass plate, said separation walls and said front surface glass plate, wherein said luminescent pixels are formed so that at least the surface of said back surface glass plate opposite and facing said display surface is a reflection surface, and wherein the reflection surface opposite said display surface has a concave surface, and the light reflected from said reflection surface is condensed at the display surface.

* * * * *